US011892270B2

(12) United States Patent
Cheng

(10) Patent No.: US 11,892,270 B2
(45) Date of Patent: Feb. 6, 2024

(54) SIGHT AND COMPENSATING MECHANISM THEREOF

(71) Applicants: Sintai Optical (Shenzhen) Co., Ltd., ShenZhen (CN); Asia Optical Co., Inc., Taichung (TW)

(72) Inventor: Tung-Yao Cheng, Taichung (TW)

(73) Assignees: SINTAI OPTICAL (SHENZHEN) CO., LTD., Shenzhen (CN); ASIA OPTICAL CO., INC., Taichung (TW)

( * ) Notice: Subject to any disclaimer, the term of this patent is extended or adjusted under 35 U.S.C. 154(b) by 0 days.

(21) Appl. No.: 17/741,522

(22) Filed: May 11, 2022

(65) Prior Publication Data

US 2022/0373296 A1 Nov. 24, 2022

(30) Foreign Application Priority Data

May 21, 2021 (CN) ..... 202110559518.9

(51) Int. Cl.
*F41G 1/38* (2006.01)
*F41G 1/16* (2006.01)

(52) U.S. Cl.
CPC . *F41G 1/16* (2013.01); *F41G 1/38* (2013.01)

(58) Field of Classification Search
CPC ..... F41G 1/16; F41G 1/38; G02B 7/16
USPC ..... 42/111, 119
See application file for complete search history.

(56) References Cited

U.S. PATENT DOCUMENTS

| | | | | |
|---|---|---|---|---|
| 11,243,049 | B1 * | 2/2022 | Enzinger | G02B 27/36 |
| 11,248,876 | B2 * | 2/2022 | Davis | F41G 1/38 |
| 11,353,289 | B2 * | 6/2022 | Walker | F41G 1/44 |
| 2019/0128642 | A1 | 5/2019 | Davis et al. | |
| 2019/0128644 | A1 * | 5/2019 | Tang | F41G 1/38 |

FOREIGN PATENT DOCUMENTS

| | | | |
|---|---|---|---|
| TW | 201344145 | A | 11/2013 |
| TW | I690688 | B | 4/2020 |
| WO | 2006/117869 | A1 | 11/2006 |

* cited by examiner

*Primary Examiner* — Reginald S Tillman, Jr.
(74) *Attorney, Agent, or Firm* — McClure, Qualey & Rodack, LLP

(57) ABSTRACT

A sight includes a main body, an erecting unit and a compensating mechanism. The compensating mechanism includes a fixing unit, a cover and an switching unit. A compensating mechanism for a sight includes a base unit, a transmission unit, an adjusting cap, a movable unit and a lock unit. The adjusting cap is located in a first position when the adjusting cap is locked by the lock unit. The adjusting cap in the first position can be rotated in a second direction or in a third direction opposite to the second direction when the lock unit is moved in a first direction to release the adjusting cap. The adjusting cap stops in a second position when the adjusting cap is rotated in the third direction so that the movable unit is propped against an end of a groove of the adjusting cap.

16 Claims, 8 Drawing Sheets

SIGHT AND COMPENSATING MECHANISM THEREOF

BACKGROUND OF THE INVENTION

Field of the Invention

The invention relates to a compensating mechanism for a sight, and more particularly to a compensating mechanism providing two zero-point positions for a sight.

Description of the Related Art

Generally, a sight has a compensating mechanism to correct the bullet impact points, and the compensating mechanism of the sight is provided with only one zero-point position. The zero-point position, which is previously determined, will fail if the distance of the target object is less than the reference distance corresponding to the zero-point position, or if the firearm is additionally equipped with a sound suppressor or a night vision device so that the bullet impact points become nearer. Under such circumstance, the user can only correct the bullet impact points via a visual observation or the crosshair. The operation becomes inconvenient.

BRIEF SUMMARY OF THE INVENTION

An object of the invention is to provide a compensating mechanism for a sight. The compensating mechanism has two zero-point positions, thus providing flexible options for users and being convenient in operation.

The compensating mechanism in accordance with an exemplary embodiment of the invention includes a base unit, a transmission unit, an adjusting cap, a movable unit and a lock unit. The transmission unit is carried by the base unit. The adjusting cap connects to the transmission unit and includes a groove. The movable unit is disposed between the transmission unit and the base unit and includes a movable element. The lock unit is movably disposed onto the adjusting cap. When the adjusting cap is rotated, the movable unit is axially moved with respect to the base unit so that the movable element enters or leaves the groove. The adjusting cap is located in a first position when the adjusting cap is locked by the lock unit. The adjusting cap in the first position can be rotated in a second direction or in a third direction opposite to the second direction when the lock unit is moved in a first direction to release the adjusting cap. The adjusting cap stops in a second position when the adjusting cap is rotated in the third direction so that the movable element is propped against an end of the groove.

In another exemplary embodiment, the lock unit includes a main body. The main body includes a concave hole. The adjusting cap is locked in the first position when the movable element enters the concave hole.

In yet another exemplary embodiment, the transmission unit is rotated only with respect to the base unit. The movable element is moved away from the groove when the adjusting cap is rotated in the second direction.

In another exemplary embodiment, the groove is curved.

In yet another exemplary embodiment, the main body further includes a passage communicating with the concave hole.

In another exemplary embodiment, the lock unit releases the adjusting cap when the movable element leaves the concave hole and enters the passage, so that the adjusting cap is rotatable in the second direction or in the third direction.

In yet another exemplary embodiment, the compensating mechanism further including a guide pin, wherein the main body further includes a guide groove, and the guide pin penetrates the guide groove and is fixed to an interior of the adjusting cap.

In another exemplary embodiment, the compensating mechanism further includes a guide pin, wherein the main body further includes a guide groove, the guide pin penetrates the guide groove and is fixed to an interior of the adjusting cap, the guide pin is moved with respect to the guide groove to guide movement of the main body with respect to the adjusting cap when the main body is moved in the first direction and with respect to the adjusting cap so that the movable element leaves the concave hole and enters the passage.

In yet another exemplary embodiment, the lock unit further includes an elastic element disposed between the main body and the adjusting cap and propped against the main body and the adjusting cap.

In another exemplary embodiment, the adjusting cap further includes an indentation formed next to the groove, and the elastic element is propped against the indentation of the adjusting cap.

In yet another exemplary embodiment, the movable unit further includes a contact element disposed around the transmission unit, and the contact element is axially moved with respect to the base unit when the adjusting cap is rotated.

In another exemplary embodiment, the movable element is disposed on the contact element, and the contact element and the movable element are axially moved with respect to the base unit when the adjusting cap is rotated.

In yet another exemplary embodiment, the base unit includes an upper cover, the movable element includes a flange portion, and the movable protrudes from the upper cover and extends into the groove when the flange portion is propped against the upper cover.

In another exemplary embodiment, the upper cover includes a through hole, the movable element further includes a nut portion and a threaded portion, the nut portion and the threaded portion are respectively connected to opposite sides of the flange portion, the threaded portion is connected to the contact element, and the nut portion penetrates through the through hole of the upper cover.

In yet another exemplary embodiment, the compensating mechanism further includes an adjusting element connected to the transmission unit and extended to penetrate through the base unit, wherein the adjusting element is axially moved with respect to the base unit when the adjusting cap is rotated.

A sight in accordance with an exemplary embodiment of the invention includes a main body, an objective lens unit, an ocular lens unit, an erecting unit and an above-mentioned compensating mechanism. The objective lens unit and the ocular lens unit are disposed at both ends of the main body. The erecting unit is disposed within the main body. The compensating mechanism is disposed on the main body, penetrated into the main body and placed against the erecting unit.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

A sight in accordance with an embodiment of the invention includes a main body (lens barrel), a compensating mechanism 10 (shown in FIGS. 1A, 1B and 2), an objective lens unit, an ocular lens unit and an erecting unit, wherein the objective lens unit and the ocular lens unit are disposed at both ends of the main body, the erecting unit is disposed within the main body, and the compensating mechanism 10 is disposed on the main body, penetrates through the main body and is placed against the erecting unit.

Figure 1A:
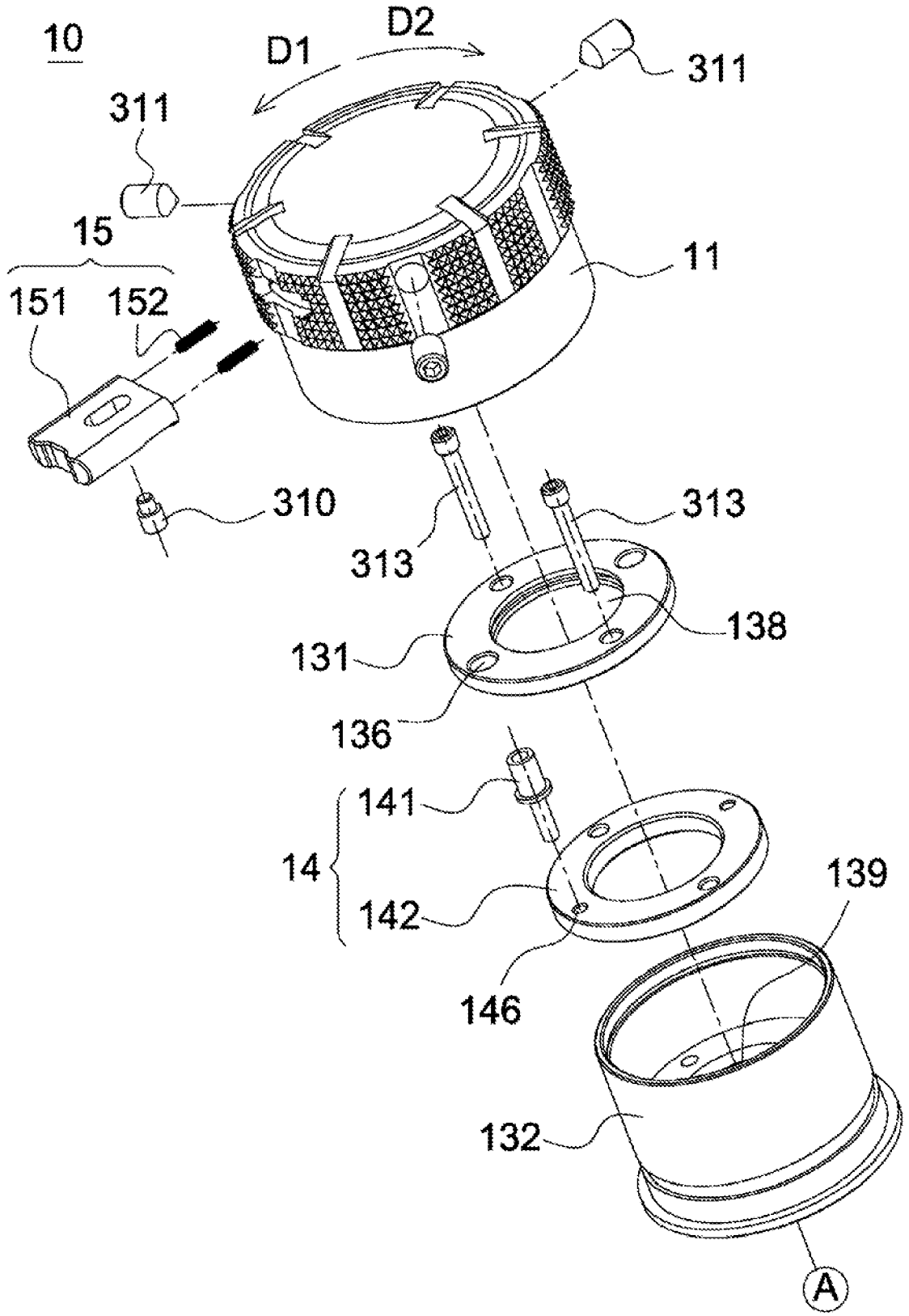
FIGS. 1A and 1B is an exploded view of a compensating mechanism for a sight in accordance with an embodiment of the invention.
Figure 1B:
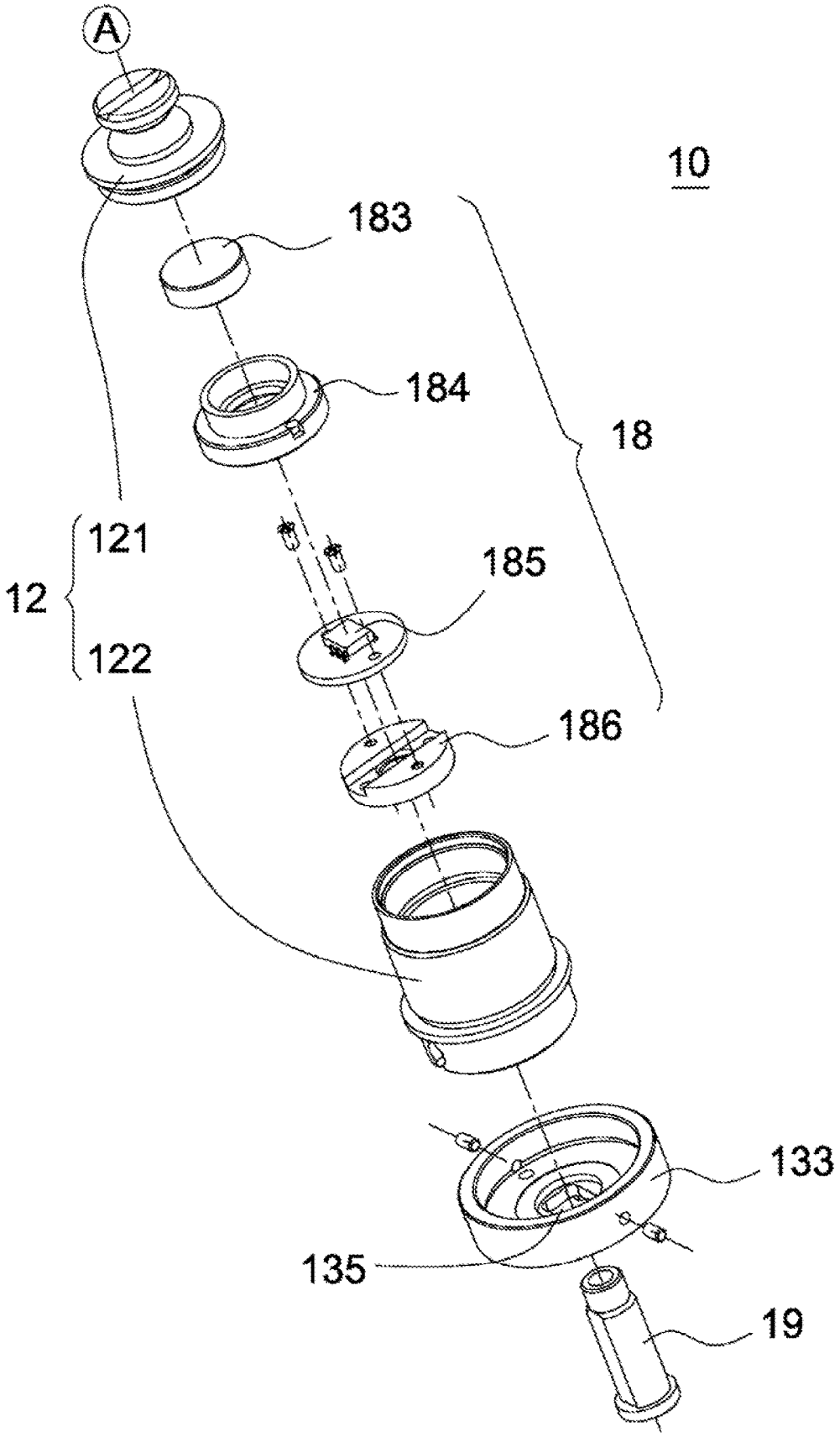
Figure 2:
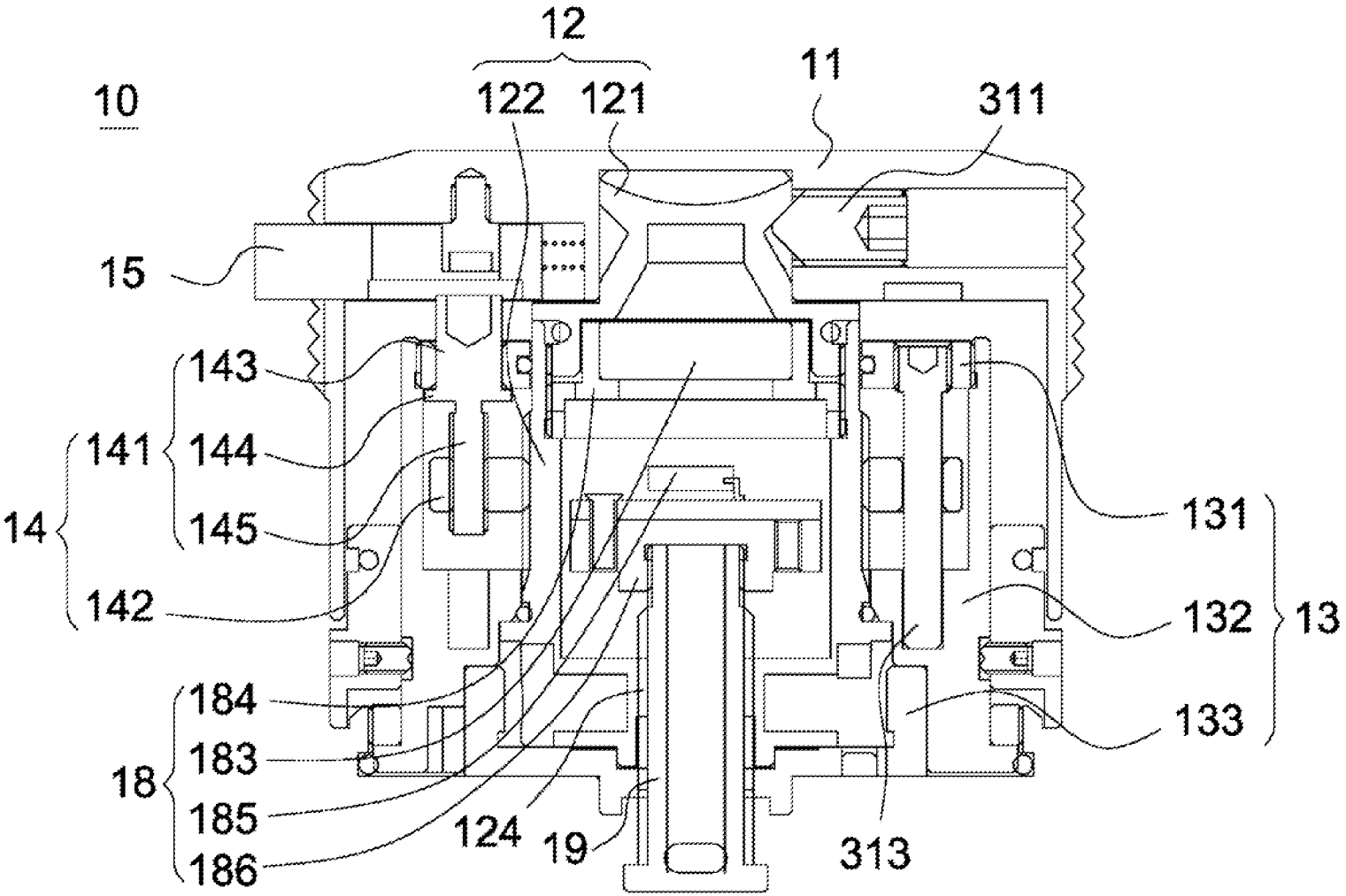
FIG. 2 depicts a cross section of the compensating mechanism of FIG. 1.

As shown in FIGS. 1A, 1B and 2, the compensating mechanism 10 includes an adjusting cap 11, a transmission unit 12, a base unit 13, a movable unit 14, a lock unit 15, a sensing unit 18 and an adjusting element 19. In operation, the user can push the lock unit 15 to release the adjusting cap 11 and rotate the adjusting cap 11 located in a first zero-point position in a second direction D1 to correct the bullet impact point for the sight. Further, the user can rotate the adjusting cap 11 in a third direction D2 opposite to the second direction D1 until the adjusting cap 11 is stopped by the movable unit 14 wherein the compensating mechanism 10 returns to the first zero-point position and the adjusting cap 11 is relocked by the lock unit 15. However, if the user pushes the lock unit 15 again to release the adjusting cap 11, then the user can continue to rotate the adjusting cap 11 in the third direction D2 until the compensating mechanism 10 reaches a second zero-point position. The structure and assembly of each element are described in detail in the following.

The base unit 13 is fixed to the main body of the sight. The base unit 13 includes an upper cover 131, a sleeve 132 and a mount 133. The mount 133 is disposed on the main body of the sight. The sleeve 132 is disposed on the mount 133. The upper cap 131 is disposed on an end portion of the sleeve 132 that is distant from the mount 133. The upper cover 131 has a first central hole 138. The sleeve 132 has a second central hole 139. The mount 133 has a third central hole 135.

The transmission unit 12 is disposed on the base unit 13 wherein the transmission unit 12 penetrates through the first central hole 138 and the second central hole 139 and is rotatable with respect to the base unit 13. In detail, the transmission unit 12 includes an upper cover 121 and a rotary container 122. The rotary container 122 is rotatably disposed in the sleeve 132, and the upper cover 121 is disposed on an end portion of the rotary container 122 that is distant from the mount 133. The rotary container 122 has a hole 124 as shown in FIG. 2. The adjusting unit 19 is disposed in the hole 124, penetrates through the third central hole 135 of the mount 133, and extends to the interior of the main body of the sight. It is worth noting that the adjusting element 19 has outer threads (not shown) on its outer circumferential surface and the hole 124 has inner threads (not shown) on its inner circumferential surface to mate with the outer threads of the adjusting element 19. It is further worth noting that the cross section of the third central hole 135 of the mount 133 fits that of the adjusting element 19 in shape. By such arrangement, the adjusting element 19 cannot be rotated with respect to the base unit 13 which is fixed. Accordingly, the adjusting element 19 can be only axially moved with respect to the base unit 13 when the rotary container 122 of the transmission unit 12 is rotated with respect to the base unit 13. Further, the rotary container 122 under constraint of the base unit 13 in the axial direction cannot be axially moved with respect to the base unit 13 when the transmission unit 12 is rotated with respect to the base unit 13. In some other embodiments, however, the rotary container 122 of the transmission unit 12 can be simultaneously rotated and axially moved with respect to the base unit 13.

The sensing unit 18 includes a magnet 183, a magnet holder 184, a Hall sensor 185 and a sensor support 186. The magnet 183 is disposed in the magnet holder 184. The magnet holder 184 is fixed to the interior of the rotary container 122 and is therefore rotated along with the rotary container 122 during the operation of correcting the bullet impact point. The Hall sensor 185 is fixed to the sensor support 186 and the sensor support 186 is fixed to an end of the adjusting element 19 that is near the magnet holder 184. The sensor support 186 is axially moved along with the adjusting element 19 during the operation of correcting the bullet impact point.

The movable unit 14 is disposed between the transmission unit 12 and the base unit 13 and includes a movable element 141 and a contact element 142. In this embodiment, the contact element 142 is an annular body and is disposed around the rotary container 122 of the transmission unit 12. The movable element 141 is disposed on the contact element 142, extends to penetrate through the upper cover 131 of the base unit 13, and protrudes from the upper cover 131. It is worth noting that the rotary container 122 has outer threads (not shown) on its outer circumferential surface and the contact element 142 has inner threads (not shown) on its inner circumferential surface to mate with the outer threads of the rotary container 122. By such arrangement, the contact element 142 and the rotary container 122 always have a relative movement in the axial direction of the compensating mechanism while they have a relative rotation with respect to each other. Further, two guide rods 313 sequentially penetrate through the upper cover 131 and the contact element 142, and are fixed to the sleeve 132 of the base unit 13. By such arrangement, the contact element 142 cannot be rotated with respect to the base unit 13. Accordingly, the contact element 142 and the movable element 141 disposed thereon can be only axially moved with respect to the base unit 13 when the rotary container 122 of the transmission unit 12 is rotated with respect to the base unit 13. It is worth noting that the movable element 141 can be controlled to protrude or not to protrude from the upper cover 131 by rotation of the rotary container 122.

In this embodiment, the movable element 141 includes a nut portion 143, a flange portion 144 and a threaded portion 145, and the contact element 142 has a screw hole 146 as shown in FIG. 1A. The nut portion 143 and the threaded portion 145 are respectively connected to opposite sides of the flange portion 144, and the threaded portion 145 is connected to the contact element 142 through the screw hole 146. It is worth noting that the threaded portion 145 has outer threads (not shown) on its outer circumferential surface and the screw hole 146 has inner threads (not shown)

on its inner circumferential surface to mate with the outer threads of the threaded portion 145. By such arrangement, when the movable element 141 is rotated with respect to the contact element 142, the movable element 141 is simultaneously moved with respect to the contact element 142 in the axial direction of the compensating mechanism 10. In this embodiment, the upper cover 131 has a through hole 136 allowing penetration of the nut portion 143. The outer diameter of the flange portion 144 is greater than the outer diameter of the threaded portion 145 and is also greater than the inner diameter of the through hole 136. By such arrangement, the nut portion 143 is able to pass through the through hole 136 when the movable element 141 is axially moved towards the upper cover 131. The nut portion 144 will not be stopped before contacting the bottom of the upper cover 131. When the nut portion 144 is propped against the bottom of the upper cover 131, the nut portion 143 protrudes from the top of the upper cover 131.

Figure 3:
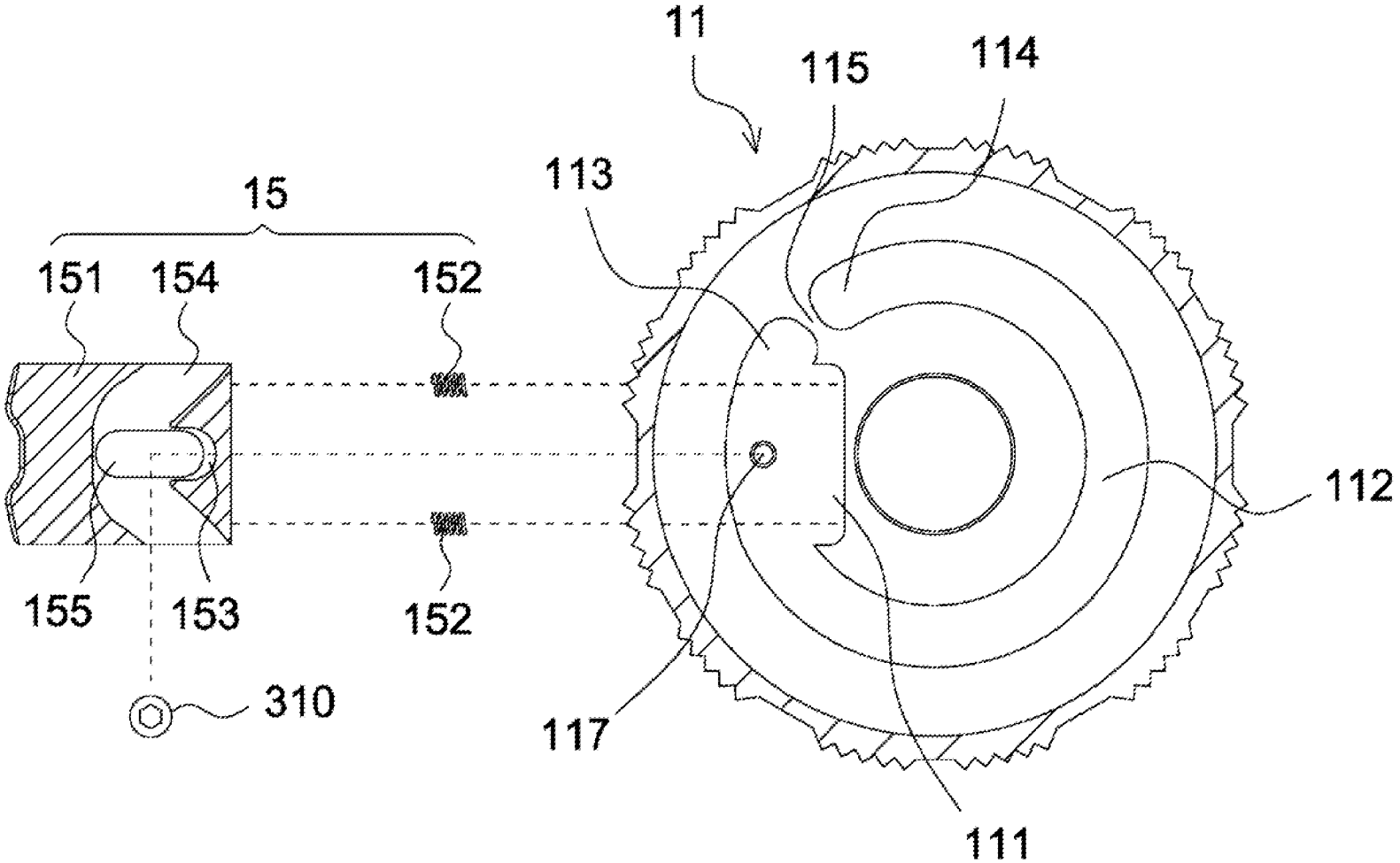
FIG. 3 is a bottom view of an adjusting cap and a lock unit of FIG. 1A.

The adjusting cap 11 is fixed to the upper cover 121 of the transmission unit 12 by a plurality of the fixing elements 311. Therefore, when the adjusting cap 11 is rotated, the transmission unit 12 is driven by the adjusting cap 11 to rotate with respect to the base unit 13. Referring to FIG. 3, the adjusting cap 11 has a surface placed towards the base unit 13 and the surface defines a groove 112. The groove 112 is curved and has two ends 113, 114. A stop portion 115 is formed between the two ends 113, 114. Accordingly, the groove 112 and the stop portion 115 constitute a complete ring. When the flange portion 144 is propped against the bottom of the upper cover 131, the movable element 141 not only protrudes from the upper cover 131 but enters the groove 112. By such arrangement, the movable element 141 may contact the stop portion 115 so that the adjusting cap 11 is constrained from rotation and stops in a second zero-point position.

Further, an indentation 111 is formed next to the groove 112 for receiving the elastic elements 152. The elastic elements 152 may be (for example) compression springs. The lock unit 15 is placed to push the elastic elements 152 against the indentation 111. The lock unit 15 includes a main body 151 that is provided with a guide groove 155. The guide groove 155 penetrates the main body 151 from its top surface to its bottom surface. The main body 151 is further provided with a passage 154. The passage 154 extends to both side surfaces of the main body 151. The guide groove 155 and the passage 154 communicate with each other in the main body 151. A guide pin 310 penetrates through the guide groove 155 from the bottom of the main body 151 and is fixed to the fixing hole 117 formed on the inner surface of the adjusting cap 11. When the main body 151 of the lock unit 15 is pushed to move with respect to the adjusting cap 11, the guide pin 310 slides in the guide groove 155 so that the main body 151 is guided to move in the radial direction (a first direction) of the adjusting cap 11. Further, the bottom of the guide pin 310 is placed in the guide groove 155 so as to limit the radial movement of the main body 151 and to prevent a separation of the main body 151 from the adjusting cap 11. Further, the interior of the main body 151 is provided with a concave hole 153 communicating with the passage 154. When the movable element 141 enters the concave hole 153, the adjusting cap 11 is constrained from rotation and stops in a first zero-point position.

Before bullet impact points are corrected, zero-point setting for the compensating mechanism 10 is required. In the invention, two zero-point positions are necessarily set in advance, which are a first zero-point position and a second zero-point position respectively. It is assumed that the first zero-point position corresponds to a reference distance (e.g. the distance of the bullet impact point is one hundred yards, but the invention is not limited thereto), and the second zero-point position corresponds to a shorter distance (e.g. the distance of the bullet impact point is reduced from one hundred yards to seventy-five yards because of a sound suppressor additionally equipped, but the invention is not limited thereto). In operation, the user removes the adjusting cap 11, manually rotates the movable element 141 so that the movable element 141 is lowered to the lowest position and contacts the contact element 142, and fires for setting the zero-point position (the target is placed one hundred yards away). The user can rotate the upper cover 121 to determine the position of the adjusting element 19 according to the bullet impact location, thereby finishing the setting of the first zero-point position. Then, the user continues to rotate the upper cover 121 to a predetermined range (the range is determined in advance by calculation from the difference between the reference distance and the shorter distance) (e.g. the range means nine clicks but the invention is not limited thereto), thereby finishing the setting of the second zero-point position. Then, the user rotates the movable element 141 so that the movable element 141 is axially moved towards the upper cover 131 with respect to the contact element 142 until the flange portion 144 is propped against the bottom of the upper cover 131 and stops, where the movable element is in the highest position that ensures the movable element 141 can enter the groove 112 when the adjusting cap 11 is put back. Then, the user puts the adjusting cap 11 back, with the end 113 of the groove 112 aligned with the movable element 141 and the movable element 141 propped against the stop portion 115. Then, the user fixes the adjusting cap 11 and the transmission unit 12 together by the fixing elements 311. Thus, the zero-point setting for the sight is completed.

After the zero-point setting is completed, the adjusting cap 11 is in the second zero-point position. The user can rotate the adjusting cap 11 back to the first zero-point position so that the lock unit 15 is ejected to lock the adjusting cap 11 (FIG. 4) and the movable element 141 is held in the concave hole 153 of the lock unit 15 to prevent the adjusting cap 11 from rotation.

Figure 5:
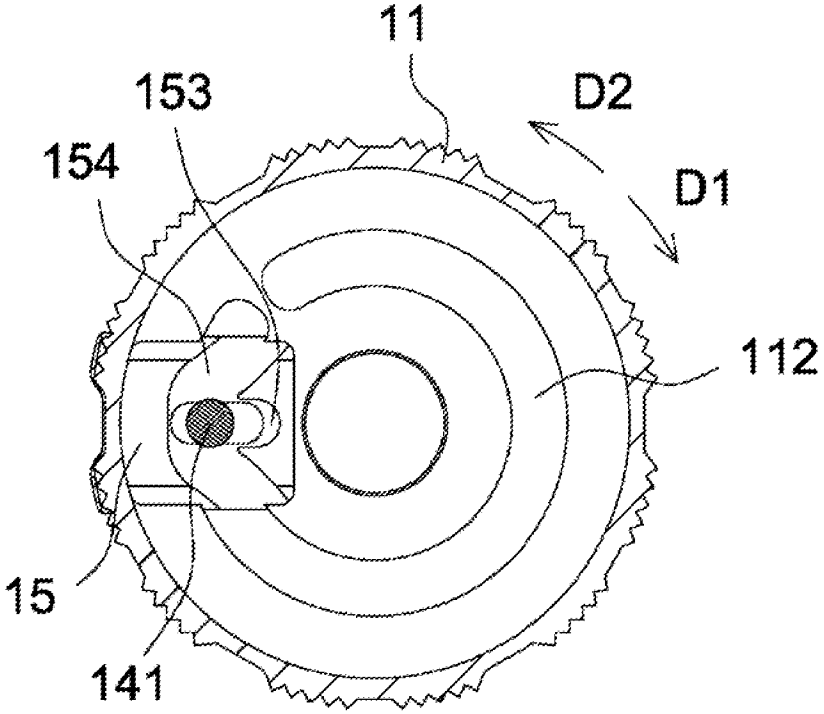
FIGS. 4-10 depict the operation of the movable element, the adjusting cover and the lock unit during the process of compensating the bullet impact point in accordance with an embodiment of the invention.
Figure 7:
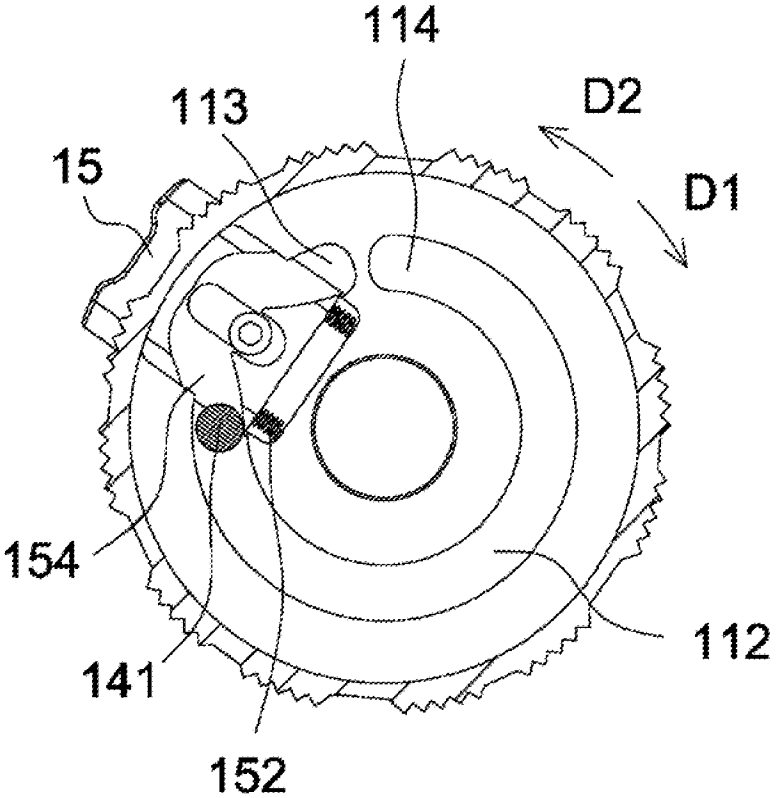
Figure 6:
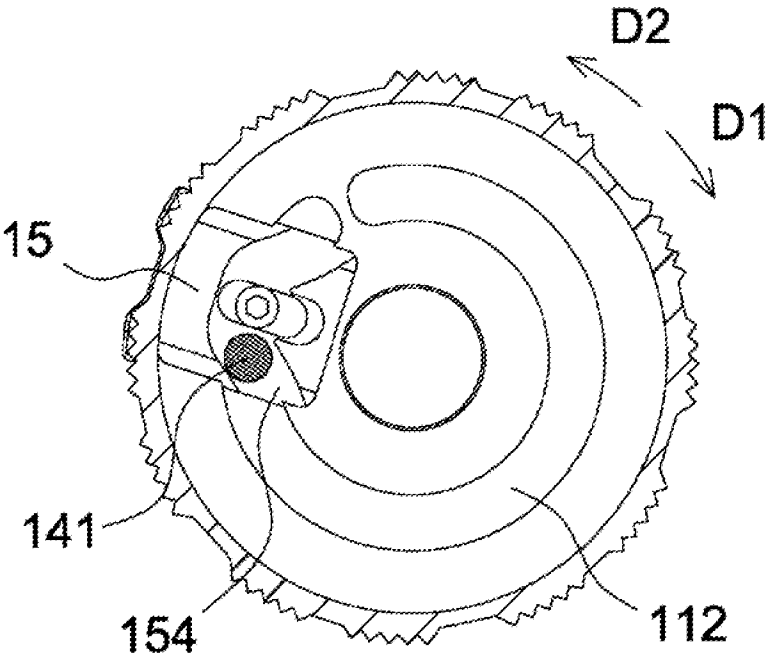
Figure 8:
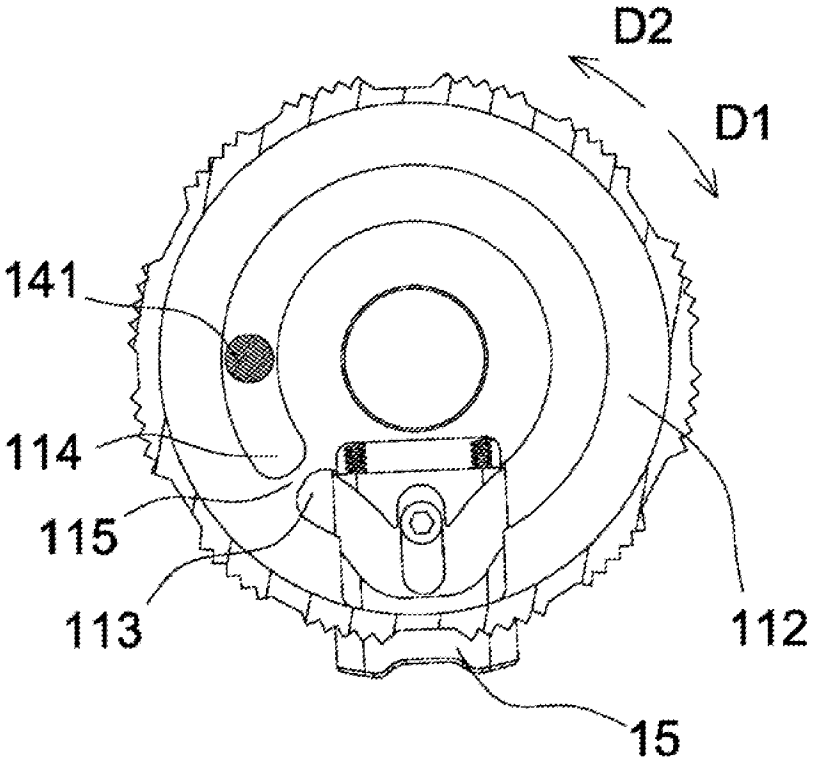

The compensating mechanism with the zero-point setting completed is now ready for a formal shooting. That is, the user can use it to correct the bullet impact points, wherein the user can push the lock unit 15 for releasing the adjusting cap 11 (FIG. 5) and rotate the adjusting cap 11 to correct the bullet impact points. In detail, the user pushes the lock unit 15 to move the movable element 141 out of the concave hole 153 (FIG. 5), rotates the adjusting cap 11 in the second direction D1 to force the movable element 141 into the passage 154 (FIG. 6), continues to rotate the adjusting cap 11 so as to force the movable element 141 out of the passage 154 and to reject the lock unit 15 under the action of the elastic element 152 (FIG. 7), and continues to rotate the adjusting cap 11 in the second direction D1 to correct the bullet impact points (FIG. 8). During the operation, the adjusting cap 11 is rotated, the transmission unit 12 is driven by the adjusting cap 11 to rotate, and the adjusting element 19 is driven by the transmission unit 12 to axially move with respect to the base unit 13. During the rotation of the transmission unit 12, the movable element 14 and the contact element 142 are axially moved with respect to the base unit 13 and away from the upper cover 131. It is worth noting that the movable element 141 already leaves the groove 112 when a complete turn of the adjusting cap 11 is made. Accordingly, the movable element 141 is not blocked from movement by the stop portion 115, and the user can continue to rotate the adjusting cap 11 in the second direction D1 to correct the bullet impact points.

Figure 4:
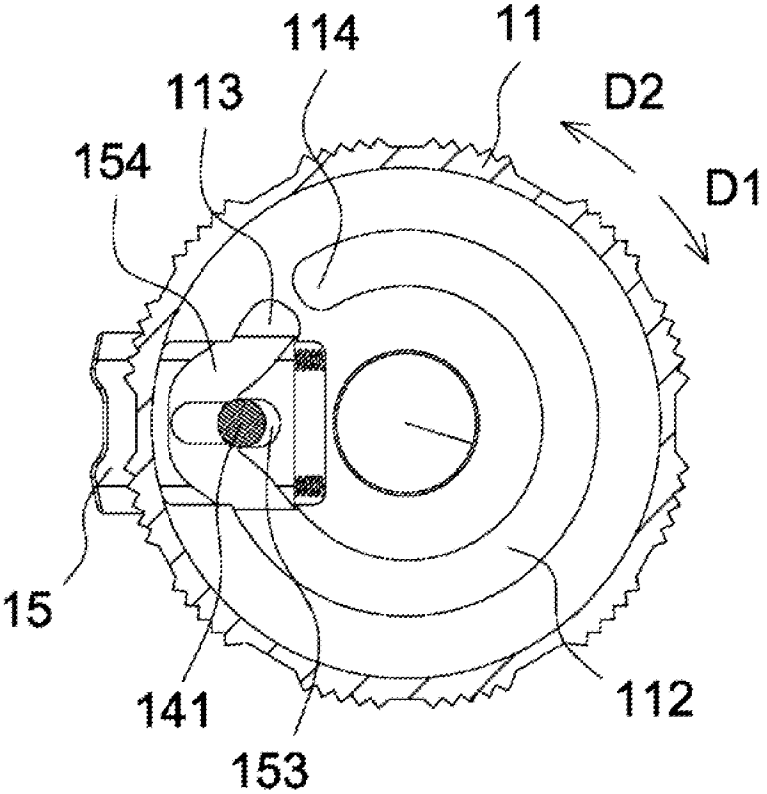

During the described operation, the user can restore the compensating mechanism to the first zero-point position at any time. In detail, the user can rotate the adjusting cap 11 in the third direction D2 (opposite to the second direction), thereby driving the transmission unit 12 to rotate and axially moving the adjusting element 19. During the rotation of the transmission unit 12, the movable element 141 and the contact element 142 are axially moved with respect to the base unit 13 and towards the upper cover 131, the movable element 141 enters the groove 112, passes through the passage 154 of the lock unit 15, and returns to the concave hole 153, and the lock unit 15 is rejected to lock the adjusting cap 11 (FIG. 4).

Figure 9:
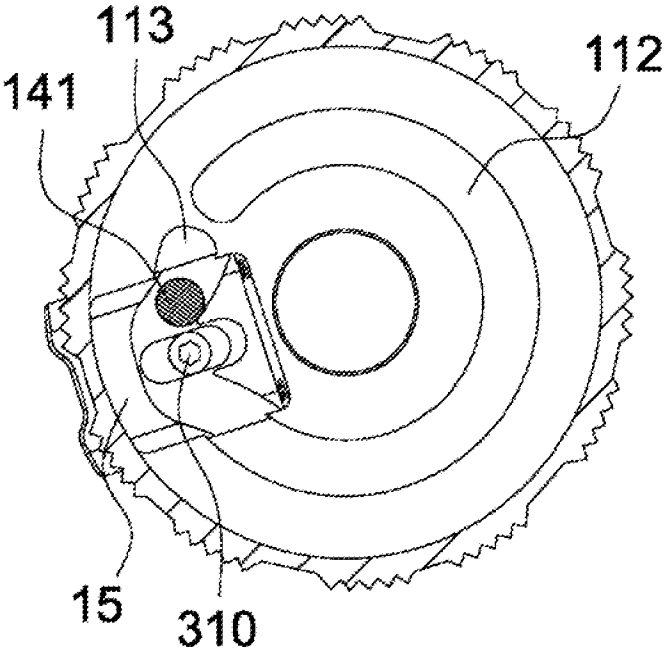
Figure 10:
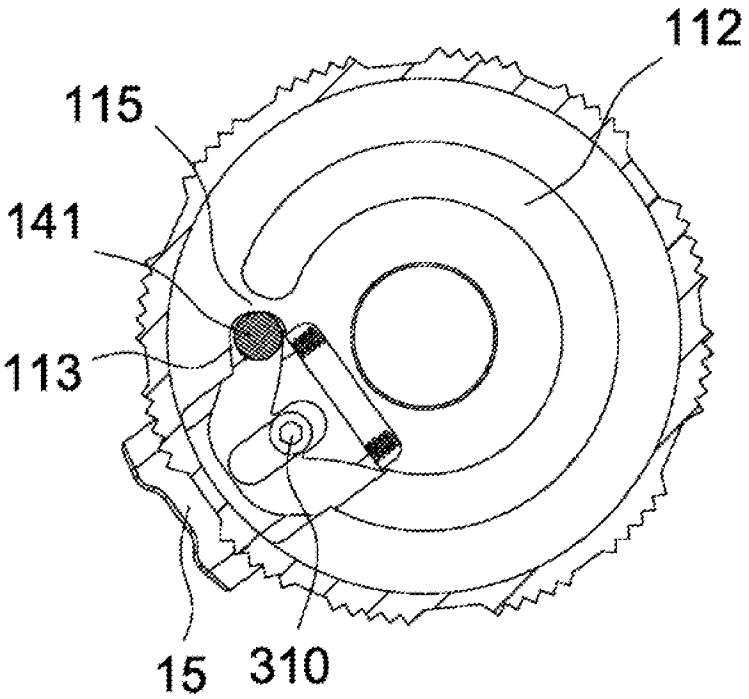

If changing the compensating mechanism 10 to the second zero-point position is desired, then the user can push the lock unit 15 to move the movable element 141 out of the concave hole 153, and rotate the adjusting cap 11 in the third direction D2 (FIG. 9) until the movable element 141 reaches the end 113 of the groove 112 and is propped against the stop portion 115. Thus, the adjusting cap 11 is in the second zero-point position and cannot continue to rotate in the third direction D2, the flange portion 144 is propped against the bottom of the upper cover 131, and the movable element 141 is raised to the highest location.

The invention provides two zero-point positions for the user, by means of the cooperation of the movable unit 14 with the lock unit 15. It provides flexible options for users and is convenient in operation.

What is claimed is:

1. A compensating mechanism for a sight, comprising:
a base unit;
a transmission unit carried by the base unit;
an adjusting cap connecting to the transmission unit and comprising a groove wherein the groove comprises a first end and a second end;
a movable unit disposed between the transmission unit and the base unit and comprising a movable element;
a lock unit movably disposed onto the adjusting cap,
wherein when the adjusting cap is rotated, the movable unit is axially moved with respect to the base unit so that the movable element enters or leaves the groove;
wherein the adjusting cap is located in a first position when the adjusting cap is locked by the lock unit;
wherein the adjusting cap in the first position can be rotated in a second direction or in a third direction opposite to the second direction when the lock unit is moved in a first direction to release the adjusting cap;
wherein the first end, the movable element and the second end are sequentially arranged along the groove, when the adjusting cap in the first position is released by the lock unit;
wherein the adjusting cap stops in a second position when the adjusting cap is rotated in the third direction so that the movable element is propped against the second end of the groove.

2. The compensating mechanism as claimed in claim 1, wherein:
the lock unit comprises a main body;
the main body comprises a concave hole;
the adjusting cap is locked in the first position when the movable element enters the concave hole.

3. The compensating mechanism as claimed in claim 1, wherein:
the transmission unit is rotated only with respect to the base unit;
the movable element is moved away from the groove when the adjusting cap is rotated in the second direction.

4. The compensating mechanism as claimed in claim 1, wherein the groove is curved.

5. The compensating mechanism as claimed in claim 2, wherein the main body further comprises a passage communicating with the concave hole.

6. The compensating mechanism as claimed in claim 5, wherein the lock unit releases the adjusting cap when the movable element leaves the concave hole and enters the passage, so that the adjusting cap is rotatable in the second direction or in the third direction.

7. The compensating mechanism as claimed in claim 2, further comprising a guide pin, wherein:
the main body further comprises a guide groove;
the guide pin penetrates the guide groove and is fixed to an interior of the adjusting cap.

8. The compensating mechanism as claimed in claim 5, further comprising a guide pin, wherein:
the main body further comprises a guide groove;
the guide pin penetrates the guide groove and is fixed to an interior of the adjusting cap;
the guide pin is moved with respect to the guide groove to guide movement of the main body with respect to the adjusting cap when the main body is moved in the first direction and with respect to the adjusting cap so that the movable element leaves the concave hole and enters the passage.

9. The compensating mechanism as claimed in claim 2, wherein the lock unit further comprises an elastic element disposed between the main body and the adjusting cap and propped against the main body and the adjusting cap.

10. The compensating mechanism as claimed in claim 9, wherein the adjusting cap further comprises an indentation formed next to the groove, and the elastic element is propped against the indentation of the adjusting cap.

11. The compensating mechanism as claimed in claim 1, wherein the movable unit further comprises a contact element disposed around the transmission unit, and the contact element is axially moved with respect to the base unit when the adjusting cap is rotated.

12. The compensating mechanism as claimed in claim 11, wherein the movable element is disposed on the contact element, and the contact element and the movable element are axially moved with respect to the base unit when the adjusting cap is rotated.

13. The compensating mechanism as claimed in claim 1, wherein the base unit comprises an upper cover, the movable element comprises a flange portion, and the movable protrudes from the upper cover and extends into the groove when the flange portion is propped against the upper cover.

14. The compensating mechanism as claimed in claim 11, wherein the upper cover comprises a through hole, the movable element further comprises a nut portion and a threaded portion, the nut portion and the threaded portion are respectively connected to opposite sides of the flange portion, the threaded portion is connected to the contact element, and the nut portion penetrates through the through hole of the upper cover.

15. The compensating mechanism as claimed in claim 1, further comprising an adjusting element connected to the transmission unit and extended to penetrate through the base unit, wherein the adjusting element is axially moved with respect to the base unit when the adjusting cap is rotated.

16. A sight, comprising:

a main body;

an objective lens unit;

an ocular lens unit, wherein the objective lens unit and the ocular lens unit are disposed at both ends of the main body;

an erecting unit disposed within the main body; and the compensating mechanism as claimed in claim 1, disposed on the main body, penetrated into the main body and placed against the erecting unit.

* * * * *